US009226545B2

(12) United States Patent
Peyton et al.

(10) Patent No.: US 9,226,545 B2
(45) Date of Patent: Jan. 5, 2016

(54) ARTICLE OF FOOTWEAR WITH FORWARD DISPLACING CUSHIONING SYSTEM

(71) Applicant: NIKE, Inc., Beaverton, OR (US)

(72) Inventors: Lee D. Peyton, Tigard, OR (US); Zachary M. Elder, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 168 days.

(21) Appl. No.: 13/930,348

(22) Filed: Jun. 28, 2013

(65) Prior Publication Data

US 2015/0000161 A1 Jan. 1, 2015

(51) Int. Cl.

| | |
|---|---|
| ***A43B 13/14*** | (2006.01) |
| ***A43B 3/24*** | (2006.01) |
| ***A43B 13/16*** | (2006.01) |

(52) U.S. Cl.

CPC ..... *A43B 13/14* (2013.01); *A43B 3/246* (2013.01); *A43B 13/16* (2013.01)

(58) Field of Classification Search

CPC .... A43B 13/14; A43B 13/141; A43B 13/183; A43B 13/184; A43B 13/185; A43B 5/00

USPC ..... 36/7.8, 27, 29, 61, 81, 103, 118.4

See application file for complete search history.

(56) References Cited

U.S. PATENT DOCUMENTS

| | | | | |
|---|---|---|---|---|
| 4,060,917 | A | 12/1977 | Canale | |
| 5,337,492 | A * | 8/1994 | Anderie et al. | 36/28 |
| 5,502,901 | A * | 4/1996 | Brown | 36/28 |
| 5,706,589 | A * | 1/1998 | Marc | 36/27 |
| 6,076,283 | A | 6/2000 | Boie | |
| 6,115,943 | A * | 9/2000 | Gyr | 36/35 R |
| 7,287,342 | B2 | 10/2007 | Keen | |
| 7,905,033 | B1 * | 3/2011 | Perenich | A43B 13/141 36/102 |
| 2004/0040180 | A1 * | 3/2004 | Rennex | A43B 13/184 36/28 |
| 2004/0064973 | A1 | 4/2004 | Talbott | |
| 2005/0005472 | A1 * | 1/2005 | Perenich | 36/27 |
| 2005/0262725 | A1 * | 12/2005 | Rennex | A43B 13/14 36/7.8 |
| 2005/0268488 | A1 * | 12/2005 | Hann | A43B 13/20 36/27 |
| 2008/0141559 | A1 * | 6/2008 | Marc | A43B 13/203 36/27 |
| 2010/0257753 | A1 * | 10/2010 | Bemis et al. | 36/114 |

FOREIGN PATENT DOCUMENTS

| | | | |
|---|---|---|---|
| JP | 2007508055 | A | 4/2007 |
| WO | 2007103476 | A2 | 9/2007 |

OTHER PUBLICATIONS

First Office Action, issued Dec. 24, 2013, in corresponding Chinese Patent Application No. 201210071053.3.

* cited by examiner

*Primary Examiner* — Robert J Hicks
*Assistant Examiner* — Jillian K Pierorazio
(74) *Attorney, Agent, or Firm* — Banner & Witcoff, Ltd.

(57) ABSTRACT

An article of footwear includes an upper, a midsole positioned beneath the upper; and a forward displacement assembly positioned within the midsole. The forward displacement assembly may include a biasing member, an actuator element operably connected to the biasing member, and an extension assembly positioned in a forefoot region of the midsole and operably connected to the actuator element. The extension assembly may include a movable outsole member.

18 Claims, 5 Drawing Sheets

ARTICLE OF FOOTWEAR WITH FORWARD DISPLACING CUSHIONING SYSTEM

FIELD

Aspects of this invention relate generally to an article of footwear with an improved support assembly and, in particular, to an article of footwear having a support assembly with primary members and secondary members.

BACKGROUND

Conventional articles of athletic footwear generally include two primary elements, an upper and a sole structure. The upper is secured to the sole structure and forms a void on the interior of the footwear for comfortably and securely receiving a foot. The sole structure is secured to a lower portion of the upper and is positioned between the foot and the ground. The sole structure generally incorporates multiple layers that are conventionally referred to as an insole, a midsole, and an outsole. The insole, or sockliner, is a thin, compressible member located within the void and proximate a lower surface of the foot to enhance footwear comfort.

The outsole forms a ground-engaging portion (or other contact surface-engaging portion) of the sole structure, and is formed from a durable and wear-resistant material that includes texturing to improve traction.

To keep a wearer safe and comfortable, footwear is called upon to perform a variety of functions. For example, the sole structure of footwear should provide adequate support and impact force attenuation properties to prevent injury and reduce fatigue, while at the same time provide adequate flexibility so that the sole structure articulates, flexes, stretches, or otherwise moves to allow an individual to fully utilize the natural motion of the foot.

The midsole, which is conventionally secured to the upper along the length of the upper, forms a middle layer of the sole structure and is primarily responsible for attenuating ground (or other contact surface) reaction forces to lessen stresses upon the foot and leg, may also beneficially utilizing such ground reaction forces for more efficient toe-off, and control potentially harmful foot motions, such as over pronation. Conventional midsoles may include a foam material to attenuate impact forces and absorb energy when the footwear contacts the ground during athletic activities. Other midsoles may utilize fluid-filled bladders (e.g., filled with air or other gasses) to attenuate impact forces and absorb energy.

It would be desirable to provide an article of footwear with a forward displacement assembly that reduces or overcomes some or all of the difficulties inherent in prior known devices. Particular advantages will be apparent to those skilled in the art, that is, those who are knowledgeable or experienced in this field of technology, in view of the following disclosure of the invention and detailed description of certain embodiments.

SUMMARY

The principles of the invention may be used to provide an article of footwear with a forward displacement assembly providing an increased step length for the user. In accordance with a first aspect, an article of footwear includes an upper, a midsole positioned beneath the upper; and a forward displacement assembly positioned within the midsole. The forward displacement assembly includes a biasing member, an actuator element operably connected to the biasing member, and an extension assembly positioned in a forefoot region of the midsole and operably connected to the actuator element. The extension assembly includes a movable outsole member.

In accordance with another aspect, an article of footwear includes an upper, a midsole positioned beneath the upper; and a forward displacement assembly positioned within the midsole. The forward displacement assembly includes a biasing member comprising a plurality of leaf spring members, an actuator element operably connected to the biasing member, and an extension assembly positioned in a forefoot region of the midsole. The extension assembly is operably connected to the actuator element. The extension assembly includes a movable outsole member and a plurality of extension members connecting the actuator element to the movable outsole member.

In accordance with a further aspect, an article of footwear includes an upper, a midsole positioned beneath the upper; and a forward displacement assembly positioned within the midsole. The forward displacement assembly includes a biasing member comprising a plurality of leaf spring members. The biasing member is displaceable vertically with respect to the midsole. An actuator element is operably connected to the biasing member, and an extension assembly is positioned in a forefoot region of the midsole. The extension assembly is operably connected to the actuator element. The extension assembly includes a movable outsole member and a plurality of extension members connecting the actuator element to the movable outsole member. The outsole member is movable from a first retracted condition where a bottom surface of the outsole member is in a first position with respect to the midsole, to a second extended condition where the bottom surface of the outsole member is positioned forward and below the first position.

By providing an article of footwear with a forward displacement assembly, the footwear is provided with an increased step length, thereby reducing the number of steps required by the user to travel a particular distance. These and additional features and advantages disclosed here will be further understood from the following detailed disclosure of certain embodiments.

Figure 1:
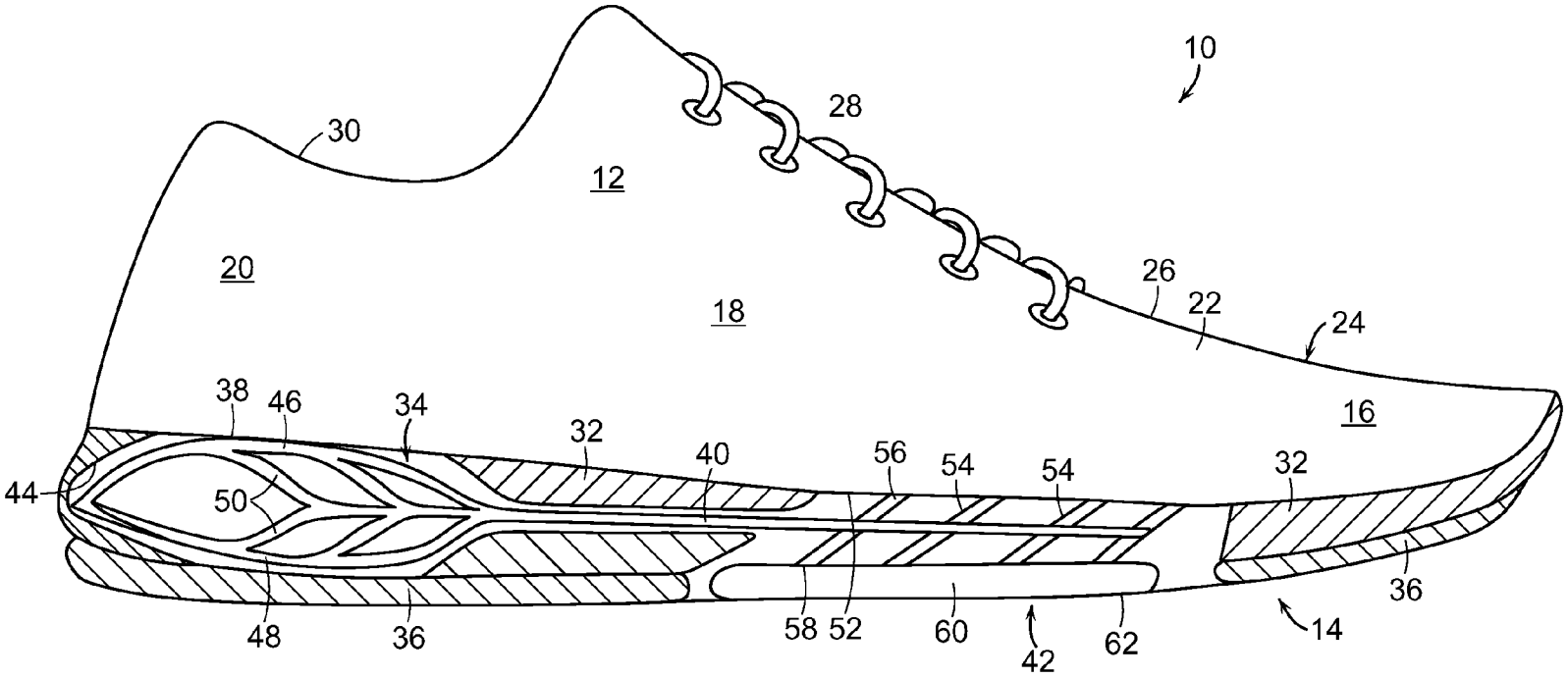
FIG. 1 is an elevation view of an article of footwear, shown partially in section, having a forward displacement assembly shown in a first retracted condition.

The figures referred to above are not drawn necessarily to scale, should be understood to provide a representation of particular embodiments of the invention, and are merely conceptual in nature and illustrative of the principles involved. Some features of the footwear with a forward displacement assembly depicted in the drawings have been enlarged or distorted relative to others to facilitate explanation and understanding. The same reference numbers are used in the drawings for similar or identical components and features shown in various alternative embodiments. Footwear with a forward displacement assembly as disclosed herein would have configurations and components determined, in part, by the intended application and environment in which they are used.

DETAILED DESCRIPTION OF CERTAIN PREFERRED EMBODIMENTS

The following discussion and accompanying figures disclose articles of footwear having a forward displacement assembly in accordance with various embodiments of the present disclosure. Concepts related to the footwear are disclosed with reference to an article of athletic footwear. The disclosed forward displacement assembly may be incorporated into a wide range of athletic footwear styles, including shoes that are suitable for hiking, running, baseball, basketball, cross-training, football, rugby, tennis, volleyball, and walking, for example. In addition, forward displacement assemblies according to various embodiments as disclosed herein may be incorporated into footwear that is generally considered to be non-athletic, including a variety of dress shoes, casual shoes, sandals, slippers, and boots. An individual skilled in the relevant art will appreciate, given the benefit of this specification, that the concepts disclosed herein with regard to the forward displacement assembly apply to a wide variety of footwear styles, in addition to the specific styles discussed in the following material and depicted in the accompanying figures.

As used herein, the terms "upper," "lower," "top," "bottom," "upward," "downward," "vertical," "horizontal," "longitudinal," "transverse," "front," "back," "forward," "rearward," etc., unless otherwise defined or made clear from the disclosure, are relative terms meant to place the various structures or orientations of the structures of the article of footwear in the context of an article of footwear worn by a user standing on a flat, horizontal surface. "Transverse" refers to a generally sideways (i.e., medial-to-lateral or heel-to-toe) orientation (as opposed to a generally vertical orientation). "Lateral" refers to a generally medial-to-lateral (i.e., side-to-side) transverse orientation. "Longitudinal" refers to a generally heel-to-toe (i.e., front-to-back) transverse orientation. A "lateral roll" is characterized by upward and/or downward displacement of a medial side of the footwear relative to a lateral side of the footwear. A "longitudinal roll" is characterized by upward and/or downward displacement of a forward side of the footwear relative to a rearward side of the footwear.

An article of footwear 10 is depicted in FIG. 1, partially in section, as including an upper 12 and a sole assembly 14. For purposes of reference in the following description, footwear 10 may be divided into three general regions: a forefoot region 16, a midfoot region 18, and a heel region 20. Regions 16-20 are not intended to demarcate precise areas of footwear 10. Rather, regions 16-20 are intended to represent general areas of footwear 10 that provide a frame of reference during the following discussion. Although regions 16-20 apply generally to footwear 10, references to regions 16-20 also may apply specifically to upper 12, sole assembly 14, or individual components within either upper 12 or sole assembly 14.

Upper 12 defines a void or chamber for receiving a foot. For purposes of reference, upper 12 includes a lateral side 22, an opposite medial side 24, and a vamp or instep area 26. Lateral side 22 is positioned to extend along a lateral side of the foot (i.e., the outside) and generally passes through each of regions 16-20. Similarly, medial side 24 is positioned to extend along an opposite medial side of the foot (i.e., the inside) and generally passes through each of regions 16-20. Upper 12 may also include a closure mechanism, such as lace 28. Upper 12 also includes an ankle opening 30 that provides the foot with access to the void within upper 12.

Upper 12 may also include an insole (or sockliner, not shown), which is generally a thin, compressible member located within the void for receiving the foot and proximate to a lower surface of the foot. Typically, the insole, which is configured to enhance footwear comfort, may be formed of foam, and optionally a foam component covered by a moisture wicking fabric or textile material. Further, the insole or sockliner may be glued or otherwise attached to the other components of footwear 10, although it need not be attached, if desired.

Sole assembly 14 includes a midsole 32 positioned below upper 12. Midsole 32 may be formed of a resilient, polymer foam material, such as polyurethane or ethylvinylacetate ("EVA"). Other suitable materials for midsole 32 will become readily apparent to those skilled in the art, given the benefit of this disclosure. In certain embodiments, it is to be appreciated that midsole 32 may incorporate sealed chambers, fluid-filled bladders.

Midsole 32 may be directly secured to upper 12 with an adhesive, for example. Suitable adhesives are well known in the art and need not be discussed in greater detail here. Midsole 32 may be secured to upper 12 with any other suitable fastening means, and such other suitable means of midsole 32 to upper 12 will become readily apparent to those skilled in the art, given the benefit of this disclosure.

A forward displacement assembly 34 is positioned below midsole 32. Support assembly 34 serves to increase the length of a user's step as they run, walk, or otherwise move forward with footwear 10.

An outsole 36 is positioned below midsole 32. Outsole 36 may be secured to midsole 32 with an adhesive, for example. Suitable adhesives are well known in the art and need not be discussed in greater detail here. Other suitable means of fastening outsole 36 to midsole 32 will become readily apparent to those skilled in the art, given the benefit of this disclosure.

Suitable materials for outsole 36 include any of the conventional rubber materials that are utilized in footwear outsoles, such as carbon black rubber compound. Other suitable materials for outsole 36 will become readily apparent to those skilled in the art, given the benefit of this disclosure.

Figure 2:
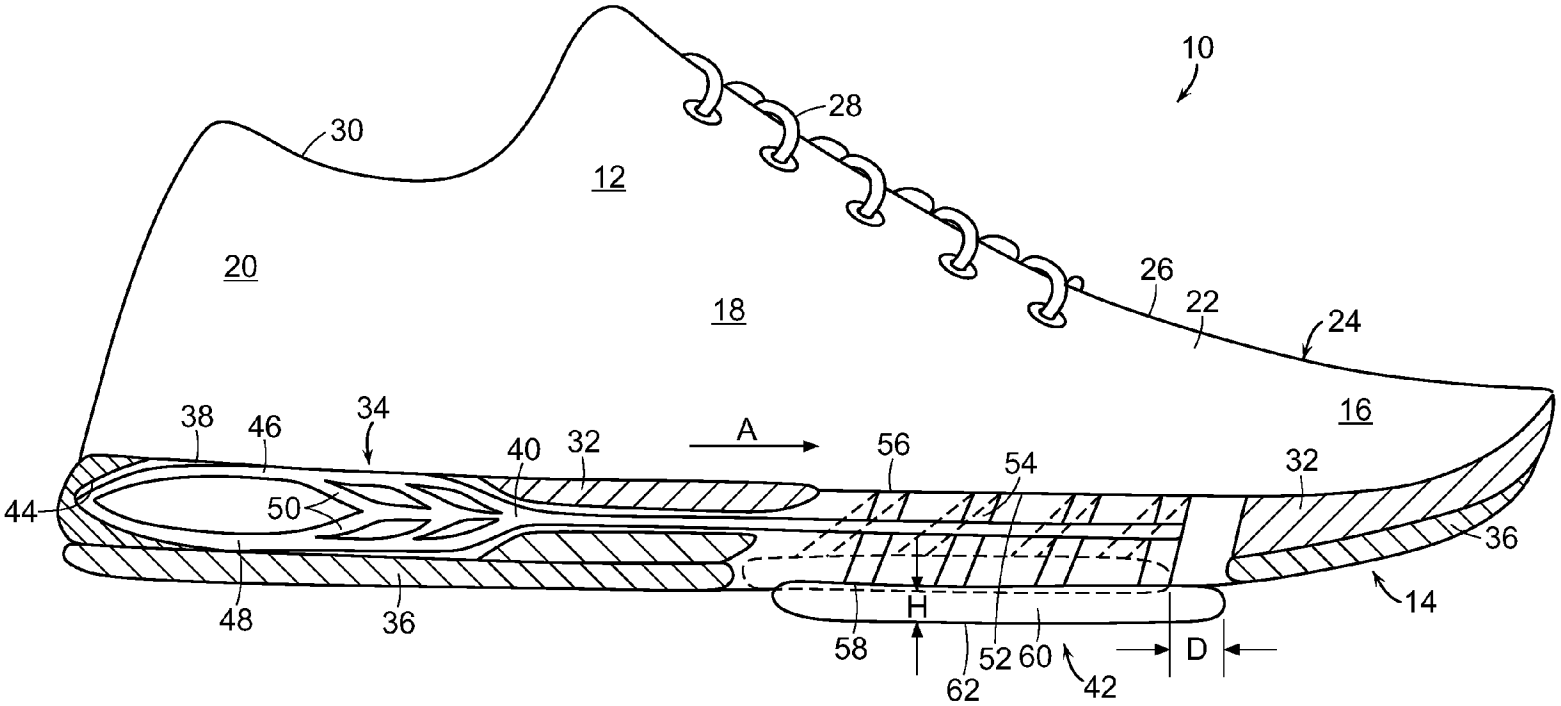
FIG. 2 is an elevation view, shown partially in section, on the footwear of FIG. 1 shown in a second extended condition.

Forward displacement assembly 34 includes a biasing member 38, an actuator element 40 operably connected to the biasing member; and an extension assembly 42. Biasing member 38 may be positioned within a first recess 44 formed in heel region 20 of midsole 32. In certain embodiments, as illustrated in FIGS. 1-2, biasing member 38 includes an upper spring plate 46 and a lower spring plate 48 spaced from upper spring plate 46. A first plurality of leaf spring members or arms 50 are connected at upper ends thereof to upper spring plate 46, and at lower ends thereof to actuator element 40, angling downwardly and forwardly from upper spring plate to actuator element 40. A second plurality of leaf spring members or arms 50 are connected at lower ends thereof to lower spring plate 48, and at upper ends thereof to actuator element 40, angling upwardly and forwardly from lower spring plate 48 to actuator element 40.

Leaf spring arms 50 are formed of a resilient material that allows them to return to their original condition after they are compressed during the user's stride, as described in greater detail below. In certain embodiments, leaf spring arms 50 are formed of an elastomer. Leaf spring arms may be formed of a polyether block copolyamide (sold as Pebax® by ATOFINA Chemicals of Philadelphia, Pa.), a blend of a polyether block copolyamide with another material (such as glass-filled nylon, carbon-filled materials, polyamides, or poly-paraphenylene terephthalamides), or thermoplastic polyurethane (TPU). Other suitable materials for leaf spring arms 50 will become readily apparent to those skilled in the art, given the benefit of this disclosure.

Actuator element 40 may be any member that is connected at a first end thereof to biasing member 38 and at an opposed end thereof to extension assembly 42. In this embodiment, actuator element 40 is a substantially rigid element, strong enough to transmit a force from biasing member 38 to extension assembly 42, as described in greater detail below. It is to be appreciated that actuator element need not be completely rigid, and may have some flexibility. In this illustrated embodiment, actuator element 40 may be a rod, a plate, or any other longitudinal member.

Extension assembly 42 may be positioned within a second recess 52 positioned in midsole 32. Second recess 52 may be positioned between midfoot region 18 and forefoot region 16 of midsole 32. In the illustrated embodiment, extension assembly 42 includes a plurality of extension members 54. Each extension member 54 has a first end 56 that is pivotally connected to the interior surface of second recess 52, and a second end 58 that is pivotally connected to an interior surface of a movable outsole member 60, such that extension members 54 extend downwardly and rearwardly from second recess 52 down to movable outsole member 60. Extension members 54 are pivotally connected at a central region thereof to actuator element 40.

The operation of forward displacement assembly 34 will now be described in greater detail. Forward displacement assembly 34 is seen in a first condition in FIG. 1, in which movable outsole member 60 is in a first retracted condition within second recess 52. In this condition, a bottom surface 62 of outsole member 60 is in a first position with respect to midsole 32 and outsole 36. In the illustrated embodiment, bottom surface 62 is substantially flush with the bottom surface of outsole 36.

When the user strides forward, forward displacement assembly moves to its second condition, as seen in FIG. 2. When the user's heel hits the ground, heel region 20 of midsole 32 is displaced vertically, compressing biasing member 38. Specifically, pressure from the user's heel in heel region 20 compresses upper spring plate 46 vertically downward toward lower spring plate 48, without any significant forward movement of upper spring plate 46 with respect to lower spring plate 48. The compression of upper spring plate 46 and lower spring plate 48 in turn compresses leaf spring arms 50, as seen in FIG. 2. The compression of leaf spring arms 50 forces actuator element 40 forward in the direction of arrow A. As actuator element 40, which is pivotally connected to extension members 54, causes extension members 54 to pivot downwardly and forwardly about their upper first ends 56. This pivoting action of extension members 54 forces movable outsole member 60 forwardly and downwardly to its second extended condition, in which bottom surface 62 of outsole member 60 is in a second position with respect to midsole 32 and outsole 36. In the second position, bottom surface 62 is positioned a distance H lower than the first position (shown in dashed lines), and a distance D forward of the first position. As seen here, bottom surface 62 of movable outsole member 60 is positioned below the bottom surface of outsole 36. In certain embodiments, distance F is between approximately 3 mm and approximately 7 mm.

As the user's weight shifts forward, the movable outsole member 60 contacts the ground in its extended second condition. As the user's weight continues to shift forward to the toes or forefoot region 16, and the force on heel region 20 is removed during toe off, the resilience of leaf spring arms 50 causes them to return to their original non-compressed condition. This causes each of actuator element 40, extension members 54, and movable outsole member 60 to return to their original first condition. Consequently, the user's step length can be increased during each step cycle, which can provide a significant benefit when a large number of steps are performed, such as in a long distance run, like a marathon.

Figure 3:
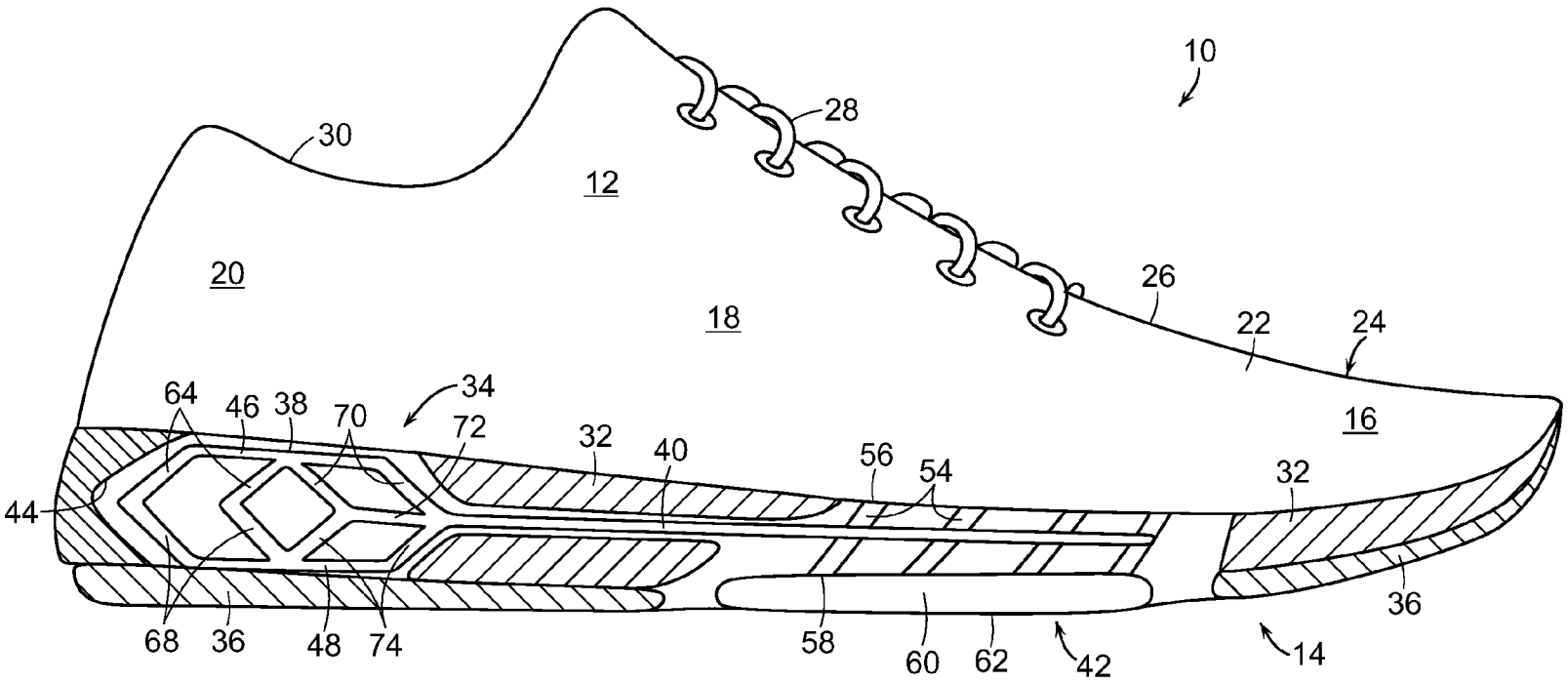
FIG. 3 is an elevation view, shown partially in section, of an alternative embodiment of an article of footwear having a forward displacement assembly shown in a first retracted condition.

Another embodiment of biasing member 38 is illustrated in FIG. 3, in which a first pair of leaf springs 64 extends downwardly and rearwardly from upper spring plate 46 and connect to a second pair of leaf springs 68 that extend upwardly and rearwardly from lower spring plate 48. A third pair of leaf springs 70 extends downwardly and forwardly from upper spring plate 46 to a forward central spring plate 72. A fourth pair of leaf springs 74 extend upwardly and forwardly from lower spring plate 48 to forward central spring plate 72.

Figure 4:
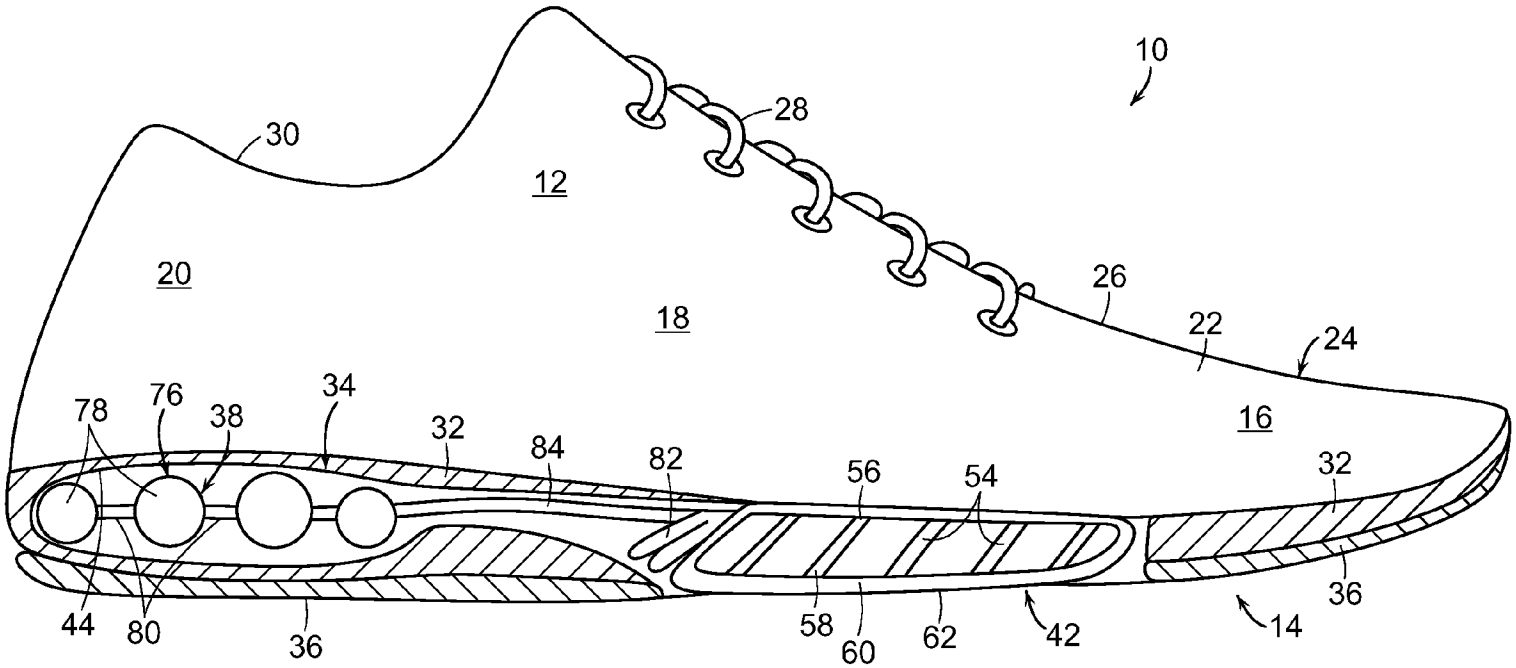
FIG. 4 is an elevation view, shown partially in section, of another alternative embodiment of an article of footwear having a forward displacement assembly shown in a first retracted condition.
Figure 5:
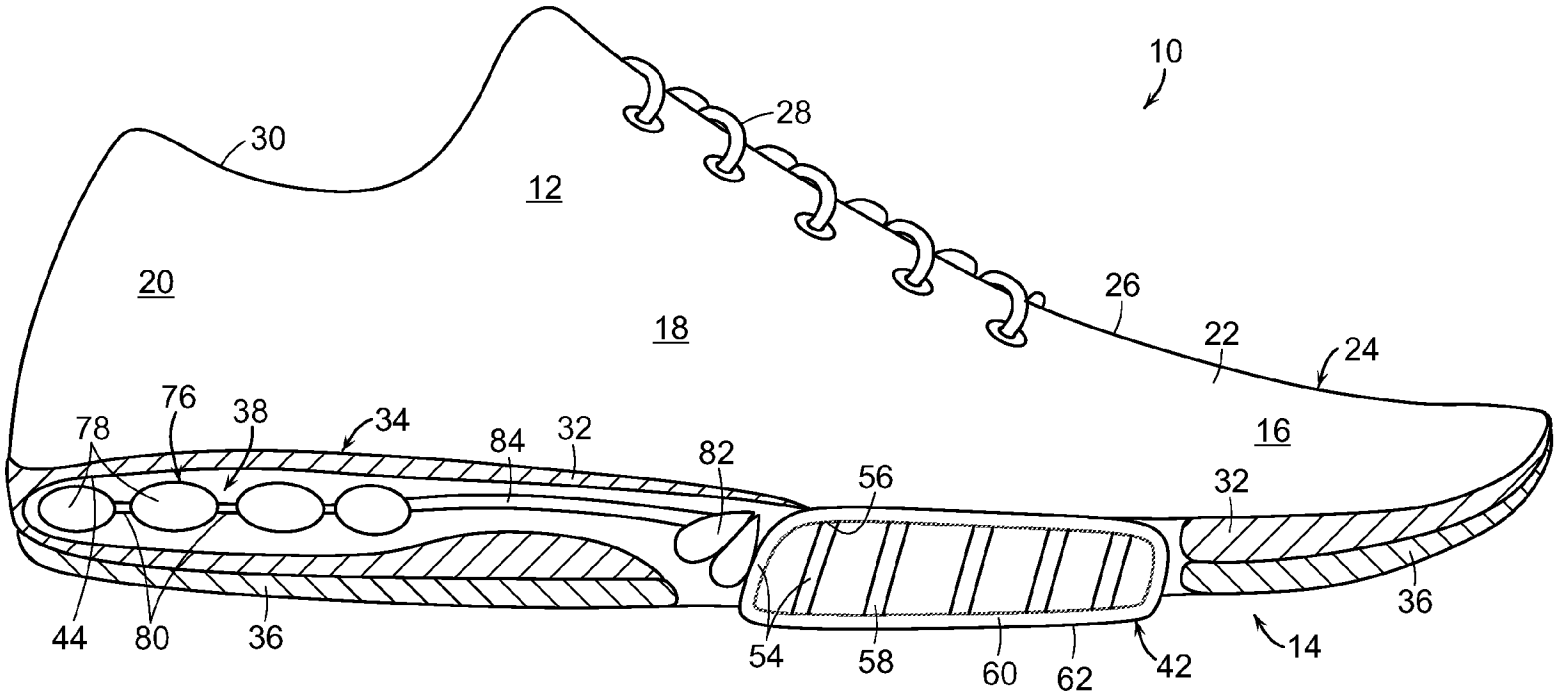
FIG. 5 is an elevation view, shown partially in section, on the footwear of FIG. 4 shown in a second extended condition.

Another embodiment is illustrated in FIGS. 4-5, in which the biasing member 38 is formed of a compressible fluid-filled bladder 76. In the illustrated embodiment, bladder 76 includes a plurality of chambers 78 in fluid communication with one another. Chambers 78 may be connected to one another with conduits 78, channels, or any other suitable members. In certain preferred embodiments, bladder 76 may be filled with water or any other liquid. In other embodiments, bladder 76 may be filled with air or any other gas.

In this embodiment, actuator element 40 includes a bellows 82, which is in fluid communication with bladder 76 with a conduit 84. Bellows 82 is directly adjacent and abutting a rearmost extension member 54 of extension assembly 42.

In this embodiment, as the user strides forward, their weight compresses chambers 78 of bladder 76, thereby forcing the fluid in bladder 76 through conduit 84 into bellows 82, which forces bellows 82 to expand. As bellows 82 expands, it forces extension members 54 to pivot downwardly and forwardly about their upper first ends 56. This pivoting action of extension members 54 forces movable outsole member 60 forwardly and downwardly to its second extended condition, in which bottom surface 62 of outsole member 60 is in a second position with respect to midsole 32 and outsole 36, as seen in FIG. 5.

Continued pressure on heel region 20 holds movable outsole member 60 in this second extended condition until the user's weight lands on it. At this point, the user's heel is lifted forward momentum propels the user forward so that the user's weight is placed on extension assembly 42. This action compresses bellows 82 such that it returns to its original non-expanded state, and the fluid is sent back through conduit 84 into bladder 76, which returns to its original non-compressed state, as seen in FIG. 4.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. An article of footwear comprising:

an upper;

a midsole positioned beneath the upper; and a forward displacement assembly positioned within the midsole and comprising:

a biasing member;

an actuator element operably connected to the biasing member; and an extension assembly positioned in a forefoot region of the midsole and operably connected to the actuator element, the extension assembly including a movable outsole member movable from a first retracted condition where a bottom surface of the outsole member is in a first position with respect to the midsole, to a second extended condition where the bottom surface of the outsole member is positioned forward and below the first position; and at least one extension member connecting the actuator element to the movable outsole member.

2. The article of footwear of claim 1, wherein the extension assembly includes a plurality of extension members connecting the actuator element to the outsole member.

3. The article of footwear of claim 2, wherein each extension member has a first end pivotally connected to the midsole and a second end pivotally connected to the outsole member, and the actuator element is pivotally connected to a central portion of each extension member.

4. The article of footwear of claim 1, wherein the outsole member moves forwardly and downwardly as it moves from its first position to its second position.

5. The article of footwear of claim 1, wherein the biasing member is in a heel region of the midsole.

6. The article of footwear of claim 1, wherein the biasing member is seated in a first recess formed in a heel region of the midsole.

7. The article of footwear of claim 6, wherein the extension assembly is seated in a second recess formed in the forefoot region of the midsole.

8. The article of footwear of claim 7, wherein the actuator element extends through a channel, the channel being connected at a first end thereof to the first recess and at a second end thereof to the second recess.

9. The article of footwear of claim 1, wherein the biasing member comprises a plurality of leaf spring members.

10. The article of footwear of claim 1, wherein the actuator element comprises a longitudinal member connected at a first end thereof to the biasing member and at a second end thereof to the extension assembly.

11. The article of footwear of claim 1, wherein the actuator element is movable in forward and rearward directions with respect to the midsole.

12. The article of footwear of claim 1, wherein the biasing member is displaceable vertically with respect to the midsole.

13. The article of footwear of claim 1, wherein the biasing member is a bladder.

14. The article of footwear of claim 13, wherein the bladder includes a plurality of chambers in fluid communication with one another.

15. The article of footwear of claim 13, wherein the actuator element includes bellows and a conduit in fluid communication with the bladder and the bellows.

16. An article of footwear comprising:

an upper;

a midsole positioned beneath the upper; and a forward displacement assembly positioned within the midsole and comprising:

a biasing member comprising a plurality of leaf spring members;

an actuator element operably connected to the biasing member; and an extension assembly positioned in a forefoot region of the midsole and operably connected to the actuator element, the extension assembly including a movable outsole member movable from a first retracted condition where a bottom surface of the outsole member is in a first position with respect to the midsole, to a second extended condition where the bottom surface of the outsole member is positioned forward and below the first position, and a plurality of extension members connecting the actuator element to the movable outsole member.

17. The article of footwear of claim 16, wherein the biasing member is displaceable vertically with respect to the midsole.

18. An article of footwear comprising:

an upper;

a midsole positioned beneath the upper; and a forward displacement assembly positioned within the midsole and comprising:

a biasing member comprising a plurality of leaf spring members and displaceable vertically with respect to the midsole;

an actuator element operably connected to the biasing member; and an extension assembly positioned in a forefoot region of the midsole and operably connected to the actuator element, the extension assembly including a movable outsole member and a plurality of extension members connecting the actuator element to the movable outsole member;

wherein the outsole member is movable from a first retracted condition where a bottom surface of the outsole member is in a first position with respect to the midsole, to a second extended condition where the bottom surface of the outsole member is positioned forward and below the first position.

* * * * *